US009833964B2

(12) United States Patent
Endou et al.

(10) Patent No.: US 9,833,964 B2
(45) Date of Patent: Dec. 5, 2017

(54) BAG MAKING APPARATUS

(75) Inventors: Tadashi Endou, Kanagawa (JP); Masayuki Nakamura, Kanagawa (JP); Hironaga Shimizu, Kanagawa (JP); Hideki Yuge, Kanagawa (JP); Yuusuke Kuboki, Kanagawa (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 865 days.

(21) Appl. No.: 14/112,351

(22) PCT Filed: Apr. 4, 2012

(86) PCT No.: PCT/JP2012/059150
§ 371 (c)(1),
(2), (4) Date: Oct. 17, 2013

(87) PCT Pub. No.: WO2012/144319
PCT Pub. Date: Oct. 26, 2012

(65) Prior Publication Data

US 2014/0045666 A1 Feb. 13, 2014

(30) Foreign Application Priority Data

Apr. 21, 2011 (JP) ..... 2011-095219

(51) Int. Cl.
*B31B 19/00* (2006.01)
*B65H 23/00* (2006.01)
(Continued)

(52) U.S. Cl.
CPC ..... *B31B 19/10* (2013.01); *B65H 23/038* (2013.01); *B65H 23/048* (2013.01);
(Continued)

(58) Field of Classification Search
CPC ..... B31B 19/00; B31B 19/02; B31B 19/10; B65H 23/18; B65H 23/044; B65H 23/032;
(Continued)

(56) References Cited

U.S. PATENT DOCUMENTS 4,070,951 A * 1/1978 Bala ..... B65H 20/24 226/113
5,244,449 A * 9/1993 Totani ..... B31B 19/10 156/157
(Continued)

FOREIGN PATENT DOCUMENTS

JP 08-217020 A 8/1996
JP 2003-033981 A 2/2003
(Continued)

OTHER PUBLICATIONS

International Search Report dated Jul. 3, 2012, issued in corresponding application No. PCT/JP2012/059150.

*Primary Examiner* — Andrew M Tecco
*Assistant Examiner* — Chelsea Stinson
(74) *Attorney, Agent, or Firm* — Westerman, Hattori, Daniels & Adrian, LLP

(57) ABSTRACT

Provided is a bag making apparatus with a simple configuration that: prevents fluctuations in tension, slippage of seal positions, and meandering or skewing of a web of film; allows the setting of precise initial conditions; reduces or makes unnecessary monitoring, and time and structures for adjustment; allows increased feed rate; and improves production efficiency. The bag making apparatus for packaging containers comprises: a tension control unit for controlling the continuous feed rate according to the values detected by a tension sensor of a tension detection roll; an optical detection unit for simultaneously recognizing multiple marks provided on the surface of the web of film at the
(Continued)

respective positions thereof; a skewing correction unit; and a seal position correction unit for adjusting the positions of multiple sealing units in the feed direction.

15 Claims, 10 Drawing Sheets

(51) Int. Cl.

| | |
|---|---|
| ***B31B 19/10*** | (2006.01) |
| ***B65H 23/038*** | (2006.01) |
| ***B65H 23/04*** | (2006.01) |
| *B31B 160/10* | (2017.01) |
| *B31B 70/10* | (2017.01) |
| *B31B 70/18* | (2017.01) |
| *B31B 155/00* | (2017.01) |
| *B31B 70/00* | (2017.01) |

(52) U.S. Cl.
CPC ..... *B31B 70/006* (2017.08); *B31B 70/10* (2017.08); *B31B 70/18* (2017.08); *B31B 2155/00* (2017.08); *B31B 2155/002* (2017.08); *B31B 2155/0014* (2017.08); *B31B 2160/10* (2017.08); *B65H 2301/4491* (2013.01); *B65H 2404/15212* (2013.01); *B65H 2701/191* (2013.01)

(58) Field of Classification Search
CPC . B65H 23/00; B65H 23/0204; B65H 23/0216
USPC ..... 493/186
See application file for complete search history.

(56) References Cited

U.S. PATENT DOCUMENTS 5,800,325 A * 9/1998 Wilkes ..... B31B 19/10 493/196
6,024,683 A * 2/2000 Wilkes ..... B26D 1/626 493/196
6,247,293 B1 * 6/2001 Todd ..... B29C 66/93431 53/329.2
6,454,689 B1 * 9/2002 Voss ..... B31B 19/10 493/11
7,021,036 B2 * 4/2006 Hiramoto ..... B65B 43/04 493/186
7,815,179 B2 * 10/2010 Taguchi ..... B26D 5/02 270/30.08
7,832,553 B2 * 11/2010 Hartness ..... B29C 63/423 206/150
2001/0002938 A1 * 6/2001 Totani ..... B31B 37/00 383/120
2004/0079830 A1 * 4/2004 McNeil ..... B65H 19/1836 242/420
2004/0132599 A1 * 7/2004 Colla ..... B31B 19/10 493/11
2007/0020014 A1 * 1/2007 Watanabe ..... G03G 15/161 400/579
2008/0054120 A1 * 3/2008 McNeil ..... B65H 19/1836 242/563
2010/0038468 A1 * 2/2010 Hein ..... B65H 23/0204 242/419.8
2011/0000948 A1 * 1/2011 Fuwa ..... B65H 23/032 226/3
2011/0147258 A1 * 6/2011 Hartness ..... B29C 63/423 206/497
2013/0214023 A1 * 8/2013 de Jong ..... B41J 11/42 226/1
2013/0248634 A1 * 9/2013 Vonderheiden ..... B65H 23/044 242/410
2013/0262019 A1 * 10/2013 Chu ..... B65H 23/032 702/123

FOREIGN PATENT DOCUMENTS

JP 2004-115213 A 4/2004
JP 2007-168147 A 7/2007
JP 2008-100466 A 5/2008

* cited by examiner

BAG MAKING APPARATUS

TECHNICAL FIELD

The present invention relates to a bag making apparatus that produces pouch containers made of plastic film and formed into a bag shape by feeding a web of film continuously and sealing predetermined portions thereof.

BACKGROUND ART

Recent years have found wide application of pouch containers made of plastic film and formed into a bag shape by sealing, for packaging various liquid contents including hygiene products such as detergent and shampoo, and food products or seasoning such as soy source. Pouch containers are also widely used as refill pouches whose contents are transferred to other containers such as plastic or glass bottles.

Such pouch containers are produced, for example, as shown in Patent Document 1 specified below, by continuously feeding superposed upper and lower webs of plastic film with plastic bottom material interposed between the two webs at both lateral edges, sealing both lateral edges in the feed direction and crossing portions extending in the width direction and spaced apart at predetermined intervals, and successively cutting the webs at the center in the width direction and at the centers of the respective crossing portions.

The cut section at the center in the width direction forms the upper end opening of each pouch container, and after the pouch is filled with the content from this opening, the opening is tightly sealed.

One known bag making apparatus for continuously mass-producing such pouch containers includes, for example, as shown in Patent Document 2 specified below, a continuous feed mechanism for continuously unwinding a rolled web of film and feeding the web of film at a predetermined speed, an intermittent feed mechanism for intermittently feeding the web of film by a predetermined amount, a feed adjustment mechanism provided between the continuous feed mechanism and the intermittent feed mechanism (shown as "accumulators 7 and 8" in Patent Document 2), and a sealing mechanism for sealing predetermined portions of at least two, upper and lower, webs of film fed by the intermittent feed mechanism.

The feed adjustment mechanism ("accumulators 7 and 8") of this known bag making apparatus is provided for absorbing slack in the web of film caused by periodic fluctuations in the feed amount between the continuous feed and the intermittent feed, and for reducing tension fluctuations. The web of film passes over a movable dancer roll, and tension applied to the moving dancer roll is made constant so as to absorb slack in the web of film between the continuous feed and the intermittent feed as well as to absorb tension fluctuations at the same time.

The feed amount for the intermittent feed is set to match the size of one pouch container, and one portion is sealed through several stages by a plurality of sealing unit aligned at an equal distance. Since the web of film stretches due to the tension at this time, the feed amount corresponding to one bag needs to be adjusted.

The apparatus is therefore configured to determine a portion to be sealed based on a mark provided on a printed surface of the web of plastic film. The mark is imaged by a CCD camera to determine its position and to detect any displacement in the position of the mark during the intermittent feed, based on which the intermittent feed amount and the spacing between the plurality of sealing unit are adjusted.

In such a bag making apparatus for producing pouch containers including a continuous feed mechanism for continuously unwinding a rolled web of film and feeding the web of film at a predetermined speed, an intermittent feed mechanism for intermittently feeding the web of film by a predetermined amount, a feed adjustment mechanism provided between the continuous feed mechanism and the intermittent feed mechanism, and a sealing mechanism for sealing predetermined portions of at least two, upper and lower, webs of film fed by the intermittent feed mechanism, in order to produce high-quality pouch containers without any displacement of the print, it is important to precisely set the position and feed amount of the intermittent feed, to reduce tension fluctuations, and to prevent wandering and skewing of the web of film, as much as possible.

Patent Document 1: Japanese Patent Application Laid-open No. 2007-168147

Patent Document 2: Japanese Patent Application Laid-open No. 2003-33981

Patent Document 3: Japanese Patent Application Laid-open No. H8-217020

The known bag making apparatus is configured to absorb slack in the web of film caused by periodic fluctuations in the feed amount between the continuous feed and the intermittent feed, and to absorb tension fluctuations at the same time, by unit of a dancer roll. The moment of inertia when the moving direction of the dancer roll is changed would sometimes not only reduce the effect of absorbing tension fluctuations but also work contrarily and cause variations in tension.

In order to keep such tension fluctuations caused by the moment of inertia within a practically tolerable range, the moving speed of the dancer roll has to be kept low. As the web of film cannot be fed at higher speed, this was a hindrance to higher productivity.

Another possible solution would be to provide a plurality of dancer rolls for the web of film to travel over, to reduce the moving speed of the dancer rolls and to reduce the influence of the moment of inertia when the moving direction is changed. However, this is not a fundamental solution, because the influence of the rotational moment of inertia when the rotation speed of the dancer rolls is changed, and of friction, is increased, contrarily.

Further, vibration of other movable elements would sometimes cause variations in tension.

To alleviate these problems, an apparatus is known, as shown in Patent Document 3 specified above, wherein a dancer roll for absorbing slack in the web of film is forcibly driven at a predetermined speed and in a predetermined range, while another dancer roll is provided for absorbing tension fluctuations, so that tension fluctuations are absorbed without increasing the number of dancer rolls.

However, although the amount of movement of the dancer roll assigned for absorbing the tension fluctuations is reduced, the problem associated with its reciprocal movement remains, and the influence of the rotational moment of inertia when the rotation speed is changed, and of friction, is inevitably increased as there is one more dancer roll. Thus, while tension fluctuations may be somewhat reduced, the feed speed of the web of film could be increased only to a limited extent.

Another problem is that the tension applied on the web of film causes the web to stretch, and tension fluctuations during continuous production cause variations in the elongation of the web of film, because of which, with the initial settings of the intermittent feed amount in the intermittent feed mechanism and the spacing between the plurality of sealing unit in the sealing mechanism that are based on the values of elongation assumed at the start of production, the position to be sealed may be displaced from a desired position.

For this reason, marks provided on the printed surface have to be imaged with a CCD camera to detect their positions for monitoring purposes during the continuous production, and when any displacement is detected, the intermittent feed amount and the spacing between the plurality of sealing unit have to be adjusted, which require extra time. The detection and adjustment may be automated, which would, however, require a complex configuration and make it harder to increase the feed speed of the web of film. Thus this was another hindrance to better production efficiency.

The reciprocal movement and changes in the rotation speed of dancer rolls would not only cause tension fluctuations but also vibration in the entire apparatus or the web of film, or cause the web of film to flutter up and down. Such vibration and fluttering are one cause of skewing of the web of film. The larger the tension fluctuations, or the action of the mechanism for absorbing tension fluctuations, the more irregularly and significantly the web would wander or skew, because of which the mechanism for correcting a bend or skew would inevitably have a complex and bulky structure.

DISCLOSURE OF THE INVENTION

The present invention is directed to solve the problems described above in conventional bag making apparatuses. An object of the invention is to provide a bag making apparatus that can prevent tension fluctuations of the web of film, displacement of seal positions, and wandering and skewing of the web with a simple structure, enable precise setting of initial conditions, reduce or make unnecessary the time or structure for monitoring or adjustment during continuous operation, and enable an increase in the feed speed of the web of film, to achieve better production efficiency.

To solve the problems described above, the invention provides a bag making apparatus, including: a continuous feed mechanism having a continuous feed roll continuously feeding a web of film; an intermittent feed mechanism having an intermittent feed roll intermittently feeding the web of film; a feed adjustment mechanism having a reciprocally movable dancer roll between the continuous feed mechanism and the intermittent feed mechanism; and a sealing mechanism sealing predetermined portions of the web of film fed by the intermittent feed mechanism; the feed adjustment mechanism including swinging drive unit for the dancer roll, a tension detection roll provided upstream of the dancer roll, a tension sensor detecting tension on the tension detection roll, and tension control unit configured to control a feed speed of the continuous feed roll in accordance with a detection value of the tension sensor, the intermittent feed mechanism including optical detection unit configured to recognize a plurality of marks on a surface of the web of film simultaneously at respective positions, unit configured to adjust an intermittent feed amount, and skew correction unit configured to correct a displacement of the web of film in a direction perpendicular to a feed direction, and the sealing mechanism including a plurality of sealing unit provided in a section where the web of film is intermittently fed, and seal position correction unit configured to adjust positions in the feed direction of the plurality of sealing unit in accordance with positions of the marks in the feed direction of the web of film which are recognized by the optical detection unit.

To solve the problems described above, in the invention, the tension detection roll is fixed in position such as to be rotatable only and not movable, and the tension sensor is configured to detect a force applied to a rotation shaft of the tension detection roll.

To solve the problems described above, in the invention, the swinging drive unit is set to move the dancer roll reciprocally at a predetermined speed and in a predetermined range, and the tension control unit controls the feed speed of the continuous feed roll based on varying detection values of the tension sensor such that the detection values of the tension sensor remain around a predetermined value.

To solve the problems described above, in the invention, the swinging drive unit is set to move the dancer roll reciprocally in a predetermined range, and the tension control unit changes a swing end position based on varying detection values of the tension sensor such that variation in the detection values of the tension sensor is reduced.

To solve the problems described above, in the invention, the tension control unit lowers a continuous feed speed of the continuous feed mechanism when the moving range of the swinging drive unit is increased, and raises the feed speed of the continuous feed mechanism when the moving range of the swinging drive unit is decreased.

To solve the problems described above, in the invention, the tension control unit controls the swinging drive unit and/or the feed speed of the continuous feed roll in consideration of information on positions of the marks in the feed direction of the web of film which are recognized by the optical detection unit.

To solve the problems described above, in the invention, the tension control unit changes a predetermined value around which detection values of the tension sensor are to remain when there is a large displacement in the positions of the marks in the feed direction of the web of film which are recognized by the optical detection unit.

To solve the problems described above, in the invention, the optical detection unit includes a plurality of two-dimensional optical sensors provided above the intermittent feed mechanism and spaced apart in the feed direction, and is configured to be able to detect two-dimensional positions of the marks provided on the surface of the web of film when the web of film is at halt.

To solve the problems described above, in the invention, the feed amount adjustment unit is configured to determine a feed amount for one intermittent feed in accordance with information on the positions of the marks in the feed direction of the web of film which are recognized by the plurality of two-dimensional optical sensors.

To solve the problems described above, in the invention, the seal position correction unit is configured to adjust spacing between the plurality of sealing unit in the feed direction in accordance with information on positions of the marks in the feed direction of the web of film which are recognized by the plurality of two-dimensional optical sensors.

To solve the problems described above, in the invention, the plurality of two-dimensional optical sensors are spaced apart by a distance corresponding to a feed amount of several intermittent feeds of the web of film.

To solve the problems described above, in the invention, the intermittent feed mechanism includes one or a plurality of intermittent feed rolls, and the skew correction unit is configured to turn at least one of the intermittent feed rolls around an axial line passing a center in the width direction of the web of film and extending perpendicularly to the web of film.

To solve the problems described above, in the invention, the skew correction unit is configured to turn at least one of the intermittent feed rolls in accordance with a relative displacement of a printed pattern on the web of film in a direction perpendicular to the feed direction recognized by the plurality of two-dimensional optical sensors.

To solve the problems described above, in the invention, the seal position correction unit is formed by a rack rail extending in the feed direction of the web of film, a pinion gear provided to each sealing unit to mesh with the rack rail, and a pinion drive motor provided for each sealing unit to drive the pinion gear.

To solve the problems described above, in the invention, the intermittent feed mechanism is configured to intermittently feed upper and lower webs of film with a bottom material interposed between the two webs of film, and the sealing mechanism is configured to seal the bottom material together with the two, upper and lower, webs of film.

To solve the problems described above, in the invention, a cutting mechanism is provided downstream of the intermittent feed mechanism to cut the web of film after sealing to separate the web of film into discrete pouch containers.

The bag making apparatus includes optical detection unit for recognizing a plurality of marks on the surface of the web of film simultaneously at respective positions, so that the pitch per one bag can be detected with a simple structure, which enables easy and quick setting of moving positions of respective constituent parts and determination of setup values, and shortens the time required for model changes.

With the tension control unit for controlling the continuous feed speed of the continuous feed roll in accordance with detection values of the tension sensor, tension can be adjusted without the influence of the moment of inertia or friction. Tension fluctuations can thus be made very small even though the web of film is fed at high speed, and occurrence of displacement in position or changes in the web elongation during continuous operation are reduced, so that time for monitoring or adjustment during the continuous operation is reduced or made unnecessary.

There is less vibration and fluttering of the web of film as the tension fluctuations are reduced. Therefore, high-quality pouch containers without any displacement of the print can be produced, with simply designed skew correction unit.

With these constituent parts together, high-quality pouch containers can be produced at high speed, even with an increased feed speed of the web of film and shortened time for setting or adjustment, so that the productivity is improved.

With the structure as set forth, as there are fewer movable parts, the influence of the moment of inertia and friction is reduced, so that, even though the operation speed is increased, tension fluctuations can be properly reduced.

With fewer movable parts, the tension fluctuations are reduced, so that vibration in the apparatus or fluttering of the web of film are reduced, which in turn reduces irregular elongation, wandering, or skewing of the web of film. Thus, with a simple correction mechanism, high-quality pouch containers without any displacement of the print can be mass-produced efficiently.

With the structure as set forth, the dancer roll is moved back and forth without complex control so that the swinging drive unit can be made simple and to have high rigidity, little speed variation, and vibration. Vibration in the apparatus and fluttering of the web of film are reduced, and tension fluctuations resulting from the swinging drive unit are prevented.

The structure as set forth enables automatic correction of timing for changing the direction of movement at both ends of the moving range of the dancer roll for absorbing a difference in the feed amount between the intermittent feed and the continuous feed, so that there is no need to adjust the timing when starting the operation after a model change, i.e., idle time and waste material for each model change can be saved, which leads to higher productivity.

Also, as the dancer roll is moved back and forth always at correct timing, tension fluctuations can be prevented more reliably.

With the structure as set forth, detected tension is used for automatic adjustment of the intermittent feed and timing for the movement of the dancer roll to maintain the tension constant. Therefore, even though the detected tension may not be directly used for adjustment of the feed speed of the continuous feed roll, it can be indirectly used for properly controlling the feed speed of the continuous feed roll.

With the structure as set forth, even when there are changes in the elongation of the web of film during the continuous operation, the tension is corrected automatically so that the recognized marks will be located at appropriate positions, and tension fluctuations are reduced, which enables production of high-quality pouch containers without any displacement of the print.

With the structure as set forth, even when there are changes in the elongation of the web of film during the continuous operation, the tension is automatically corrected to an optimal value, so that stable feeding of the web of film is achieved.

With the structure as set forth, any displacement in position of the marks in the feed direction and a direction perpendicular thereto can be detected at one time, which enables quick setting of the web to an initial position in the feed direction and correction of skew for each model change or the like. Thus, idle time and waste material for each model change can be saved, which leads to higher productivity.

With the structure as set forth, the distance between the marks can also be detected at the same time with a displacement in position of the marks, which enables quick setting of the web to an initial position in the feed direction and setting of the feed amount in accordance with the distance between the marks in the feed direction for each model change or the like. Thus, idle time and waste material for each model change can be saved, which leads to higher productivity.

As the feed amount is set correctly, tension fluctuations are reduced, and high-quality pouch containers without any displacement of the print can be produced.

With the structure as set forth, the distance between the marks can also be detected at the same time with a displacement in position of the marks, which enables quick setting of the web to an initial position in the feed direction and setting of spacing between the plurality of sealing unit in accordance with the distance between the marks in the feed direction for each model change or the like. Thus, idle time and waste material for each model change can be saved, which leads to higher productivity.

With the structure as set forth, the mark distance can be detected with a precision higher than the resolution of the two-dimensional optical sensor by dividing the detected distance between the plurality of marks, which enables more precise setting of the feed amount and the spacing between the sealing unit in the feed direction.

The structure as set forth enables fine correction of skew only by turning the intermittent feed roll so that there is no influence of external disturbances such as a large lateral force applied on the web of film. Therefore, with the precise position adjustment and reduced tension fluctuations, continuous operation is possible with higher precision and at higher speed.

With the structure as set forth, a pattern is imaged with a two-dimensional optical sensor to obtain information on multiple points on a plane, so that an amount or angle of displacement can be detected more precisely, which enables more precise correction of skewing.

With the structure as set forth, the rack rail can be secured in position at multiple points, so that a degradation of precision caused by deformation is prevented with a simple structure. Also, the pinion gears, and other parts for driving the pinion gears can be provided on lateral ends below the sealing unit to be exposed, so that the structure of the sealing unit is simplified. Thus, while precision is maintained, the structure of the entire apparatus is made lighter and simpler to make the maintenance easy.

The structure as set forth allows for efficient mass-production of stand-up pouches with a bottom.

The structure as set forth allows for cutting of pouch containers sealed with highly precise position control into discrete bags with the position precision being maintained, and thereby enables simplification or omission of a position control mechanism in the cutting process.

EXPLANATION OF REFERENCE NUMERALS

Figure 1:
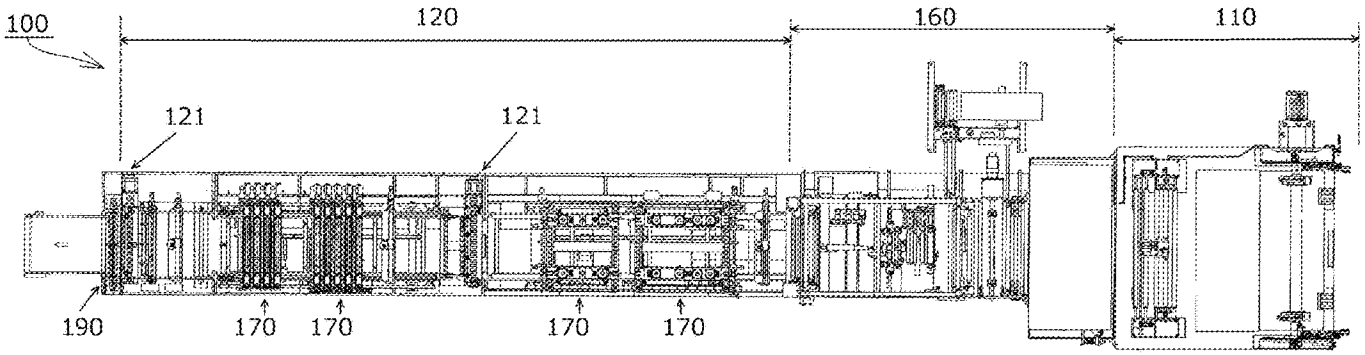
FIG. 1 is a plan view of a bag making apparatus in one embodiment of the present invention.

100: bag making apparatus
110: continuous feed mechanism
111: continuous feed roll
112: splitting mechanism
113: continuous feed motor
120: intermittent feed mechanism
121: intermittent feed roll
122: intermittent feed motor
123: intermittent feed pressing roll
124: intermittent feed roll support table
125: fixing bolt
126: film holder
127: placement piece
130: feed amount adjustment unit
140: optical detection unit
141: front-side two-dimensional optical sensor
142: rear-side two-dimensional optical sensor
150: skew correction unit
151: rotation support shaft
152: skew correction motor
153: eccentric cam
154: base table
160: feed adjustment mechanism
161: dancer roll
162: swinging drive unit
163: tension detection roll
164: tension sensor
165: tension control unit
166: superposing roll
170: sealing mechanism
171: sealing unit
172: upper frame
173: lower frame
174: slide rail
175: slider
177: drive beam
178: upper heat seal part
179: lower heat seal part
180: seal position correction unit
181: pinion gear
182: rack rail
183: pinion drive motor
184: seal unit drive shaft
190: cutting mechanism
F: web of film
M: mark
R: material roll
B: bottom material

BEST MODE FOR CARRYING OUT THE INVENTION

The bag making apparatus according to the present invention includes a continuous feed mechanism having a continuous feed roll continuously unwinding a rolled web of film and feeding the web of film at a predetermined speed, an intermittent feed mechanism having an intermittent feed roll for intermittently feeding the web of film by a predetermined amount, a feed adjustment mechanism provided between the continuous feed mechanism and the intermittent feed mechanism and including a reciprocally movable dancer roll, and a sealing mechanism sealing predetermined portions of at least two, upper and lower, webs of film fed by the intermittent feed mechanism.

Embodiments

Figure 2:
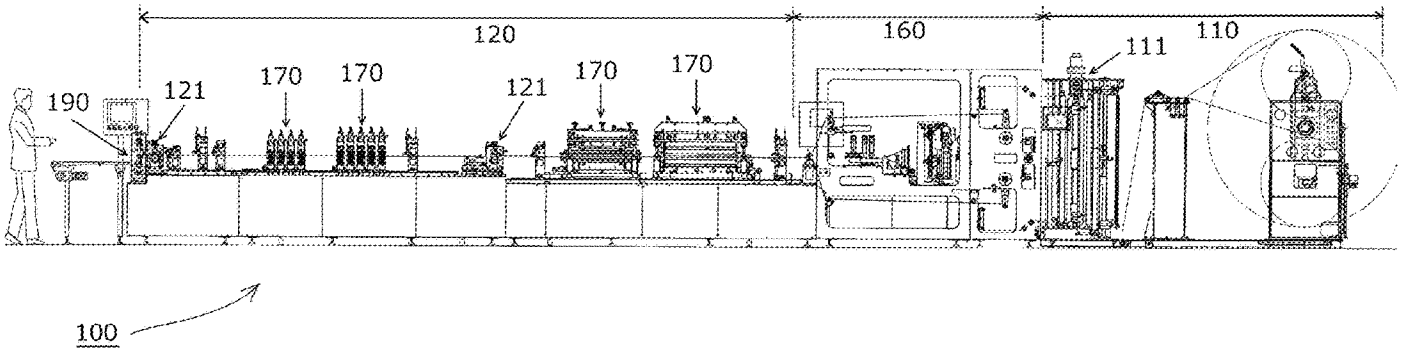
FIG. 2 is a side view of the bag making apparatus in one embodiment of the present invention.
Figure 3:
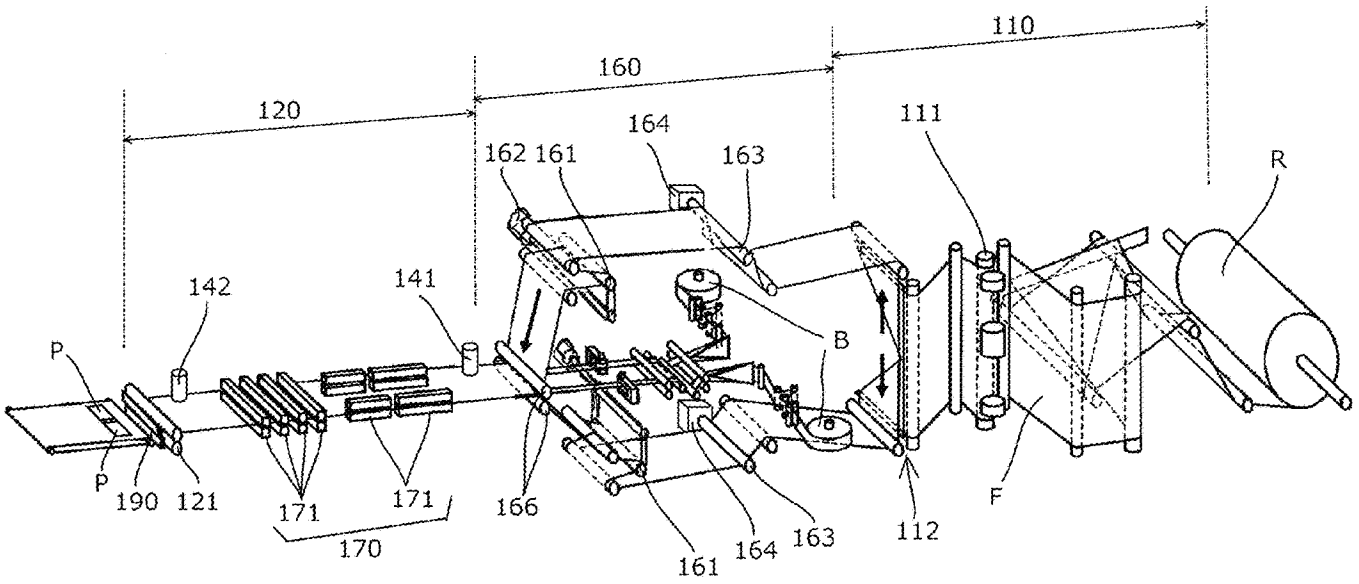
FIG. 3 is a schematic diagram for explaining the operation of the bag making apparatus in one embodiment of the present invention.

FIG. 1 and FIG. 2 are an overall plan view and side view of a bag making apparatus in one embodiment of the present invention, and FIG. 3 is a schematic diagram generally showing the operation of the apparatus.

The bag making apparatus 100 in one embodiment of the present invention is configured to continuously produce pouch containers by continuously unwinding a material roll R and feeding the web of film F successively to a continuous feed mechanism 110, a feed adjustment mechanism 160, an intermittent feed mechanism 120, and a cutting mechanism 190.

The web of film F is rolled and supplied as a material roll R in the continuous feed mechanism 110. The material roll R is axially supported to rotate around a horizontal axis, while an axially supported continuous feed roll 111 is configured to be driven around a vertical axis. The web of film F drawn out horizontally passes over a plurality of inclined guide rolls to change its direction to run along a vertical plane to be fed to the continuous feed roll 111.

Downstream of the continuous feed roll 111 is provided a splitting mechanism 112 that continuously splits the web of film F at its center into two, upper and lower, webs of film. The two, upper and lower, split webs of film F change direction to run along a horizontal plane again by the splitting mechanism 112 to be fed to the downstream feed adjustment mechanism 160.

In the feed adjustment mechanism 160, the two, upper and lower, webs of film F fed from the continuous feed mechanism 110 travel along upper and lower paths distanced from and symmetrical with each other, and are superposed at the most downstream end by superposing rolls 166, to be fed to the intermittent feed mechanism 120 to be described later.

Figure 4:
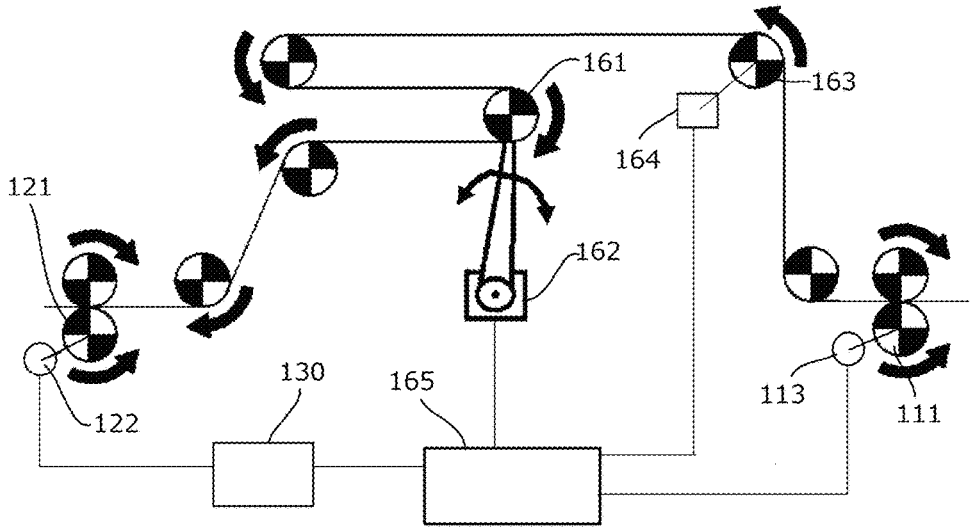
FIG. 4 is a schematic diagram for explaining a feed adjustment mechanism of the bag making apparatus in one embodiment of the present invention.

In the upper and lower, spaced apart and symmetrical paths of this feed adjustment mechanism 160 are each provided, as shown in FIG. 3 and FIG. 4, a tension detection roll 163, and a reciprocally movable dancer roll 161, so as to absorb slack in the web of film F that is caused by periodic fluctuations in the feed amount between the continuous feed and the intermittent feed and to reduce tension fluctuations.

The tension detection rolls 163 are axially supported to rotate only, and configured to determine the tension of the web of film F by detecting the force applied on the rotation shaft by a tension sensor 164.

In this embodiment, bottom material B is supplied before the superposing rolls 166 to be superposed at both lateral edges of the upper and lower webs of film F such as to be interposed between the two webs of film F.

The intermittent feed mechanism 120 is configured to intermittently feed the two, upper and lower, webs of film F with the bottom material B interposed therebetween by a predetermined amount, with an intermittent feed roll 121 disposed at the most downstream end.

The upper and lower webs of film F with the bottom material B interposed between the two webs of film F are kept horizontal between the intermittent feed roll 121 of the intermittent feed mechanism 120 and the superposing rolls 166, and sealed at both lateral edges and crossing portions extending in the width direction and spaced apart at predetermined intervals, by unit of a sealing mechanism 170 having a plurality of sealing unit 171 disposed in this section.

A front-side two-dimensional optical sensor 141 and a rear-side two-dimensional optical sensor 142 are provided at upstream and downstream positions of this section, respectively, which are connected to optical detection unit 140 so that marks on the surface of the web of film F can be detected simultaneously.

On the downstream side of the most downstream intermittent feed roll 121 of the intermittent feed mechanism 120 is disposed the cutting mechanism 190, where the web of film is cut and separated into discrete pouch containers P.

While the intermittent feed roll 121 is located most downstream in the intermittent feed mechanism 120 in the illustration shown in FIG. 3, another intermittent feed roll may be provided upstream and operated in coordination, and a few other such rolls may further be provided at suitable locations.

In the apparatus of this embodiment configured generally as described above, in the section where the upper and lower webs of film F with the bottom material B interposed between the two webs of film F are sealed at both lateral edges and crossing portions extending in the width direction and spaced apart at predetermined intervals, the tension on the web of film F is affected by the drive speed of the continuous feed roll 111, the speed, range, and timing of the reciprocal movement of the dance roll 161, and the drive speed and timing of the intermittent feed roll 121, and the elongation of the web of film F fluctuates with the tension.

Moreover, tension fluctuations and vibration during the transfer of the web of film F, or vibration of the entire apparatus may cause the web of film F to wander or skew.

In this embodiment, therefore, the apparatus has configurations that absorb tension fluctuations and determine the elongation of the web of film F so as to allow adjustment of the apparatus, whereby tension and elongation variations are reduced and stable operation is achieved, and that correct a bend or skew in the web of film F and prevent displacement in position of the seals caused by tension fluctuations, or wandering or skewing of the web of film. These configurations will be described below.

Tension control operation in the feed adjustment mechanism 160 will be described with reference to FIG. 4 (which is simplified for the sake of explanation).

The intermittent feed roll 121 intermittently feeds the web of film F under predetermined tension by a preset pitch (to be described later), which is detected by the optical detection unit 140 downstream of the feed adjustment mechanism 160. The drive speed and timing of the intermittent feed roll 121 are set in feed amount adjustment unit 130, and the speed, range, and timing of the reciprocal movement of the dancer roll 161, and the drive speed of the continuous feed roll 111, are set in tension control unit 165, in accordance with the settings in the feed amount adjustment unit 130.

The feed amount adjustment unit 130 controls an intermittent feed motor 122 to drive the intermittent feed roll 121 at the preset drive speed and with the preset timing.

The tension control unit 165 controls swinging drive unit 162 to cause the dancer roll 161 to move reciprocally with the preset speed, range, and timing, and controls a continuous feed motor 113 to drive the continuous feed roll 111 at the preset drive speed.

Once the driving starts, the tension control unit 165 performs feedback control such as PID, wherein it increases output signals instructing the drive speed of the continuous feed motor 113 in response to an increase in input signals from the tension sensor 164, and decreases the output signals in response to a decrease in the input signals, so that the average value of the input signals remains at a predetermined value. This allows for adjustment of tension without the influence of moment of inertia and friction, so that tension fluctuations are minimized even when the web of film is being fed at high speed.

The tension control unit 165 may output signals instructing the timing for switching the moving direction at both ends of the moving range of the swinging drive unit 162 in response to signal inputs from the tension sensor 164, with feedback control such as PID to minimize the difference between the maximum and minimum values of the input signals. This can further reduce the tension fluctuations caused by a difference in the timing between the intermittent drive of the intermittent feed roll 121 and the movement of the dancer roll 161.

The feedback control method and various settings such as constants or gains used in control calculations may be suitably selected in consideration of the characteristics of the entire apparatus, operation speed of the controller, cost performance, and so on, as long as the average tension can be made to remain at a predetermined value.

Also, information on the elongation of the web of film F detected by the optical detection unit 140 to be described later, and outputs from the tension sensor 164 may be processed and used in the feedback control. Tension fluctuations can further be reduced with the use of various sources of information on the tension.

Figure 5:
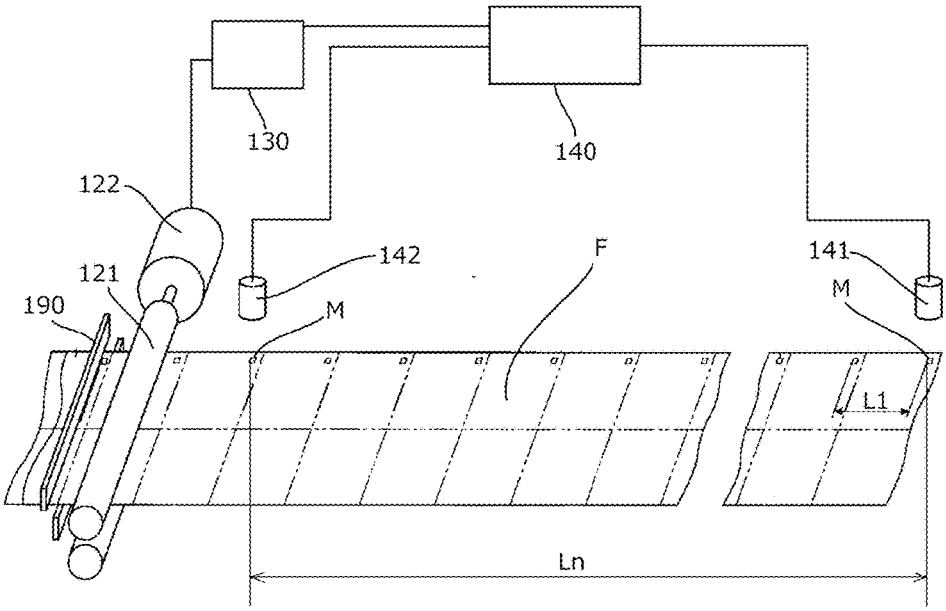
FIG. 5 is a schematic diagram for explaining optical detection unit of the bag making apparatus in one embodiment of the present invention.

Next, the structure and operation of the optical detection unit 140 for recognizing a plurality of marks on the surface of the web of film F simultaneously at respective positions will be described with reference to FIG. 5 (which is simplified for the sake of explanation).

The optical detection unit 140 is configured to display and process the image taken by the front-side two-dimensional optical sensor 141 and the rear-side two-dimensional optical sensor 142.

The front-side two-dimensional optical sensor 141 and the rear-side two-dimensional optical sensor 142 are comprised of CCD cameras spaced apart from each other and disposed such as to be able to take an image of the surface of the web of film in the section where the web of film F is fed horizontally by the intermittent feed mechanism 120. Their positions are each set accurately relative to other constituent parts of the intermittent feed mechanism 120.

When starting the production of pouch containers, the initial position for the intermittent feed is set first while the surface of the web of film F under tension is imaged by the rear-side two-dimensional optical sensor 142. An operator may perform this task while visually checking the taken image on the monitor, or the intermittent feed roll 121 may be controlled automatically based on the information detected by the optical detection unit 140.

The web of film F under tension is imaged simultaneously by the front-side two-dimensional optical sensor 141 and the rear-side two-dimensional optical sensor 142 while the web of film F is at halt, and the positions of marks M are determined by the optical detection unit 140 from the captured images to detect the distance Ln between the pouch containers spaced apart by a plurality of pitches (n pitches). Dividing this distance produces one pitch L1 for one pouch container.

The optical detection unit 140 outputs this calculated pitch L1 to the feed amount adjustment unit 130 as a feed amount for one intermittent feed.

The positions of and spacing between the plurality of sealing unit 171 to be described later are also set in accordance with the calculated pitch L1.

Since the two-dimensional optical sensors take a two-dimensional image, it is also possible to determine the positions of marks M in the width direction of the web of film F, so that the optical detection unit 140 detects a bend or skew in the web of film F based on the positional information and outputs a command for correction to skew correction unit 150 to be described later.

With a plurality of two-dimensional optical sensors, the pitch L1 for one pouch container can be detected, as well as the position of the web of film in the width direction can be detected, by imaging the web of film F tensioned with the same conditions as in actual operation just once while the web of film F is at halt.

Since the pitch L1 for one pouch container is obtained by dividing the distance Ln covering a plurality of pitches, the pitch L1 for one pouch container can be accurately calculated with a precision n times the resolution of the front-side two-dimensional optical sensor 141 and the rear-side two-dimensional optical sensor 142, so that the positions of and spacing between the plurality of sealing unit 171 to be described later can be precisely set, and the need to repeat test operation and inspection of pouch containers for each model change is obviated.

For example, if based on detection with the use of only one two-dimensional optical sensor having a resolution of 0.1 mm, the sealing unit 171 at both ends, if there are arranged ten sealing unit 171, may be displaced by as much as 1 mm, which is the sum of ten pitches. With two two-dimensional optical sensors arranged at positions spaced apart by ten pitches, the sealing unit 171 at both ends spaced apart by ten pitches will be displaced by 0.1 mm at most under initial settings, which will be well within a tolerable range.

It is also possible to calculate the positions through image processing of the two-dimensional image of characters or patterns necessary for the pouch containers, so that printing of specific marks M may be omitted.

While two two-dimensional optical sensors are provided in this embodiment, a larger number of sensors may be provided.

Figure 6:
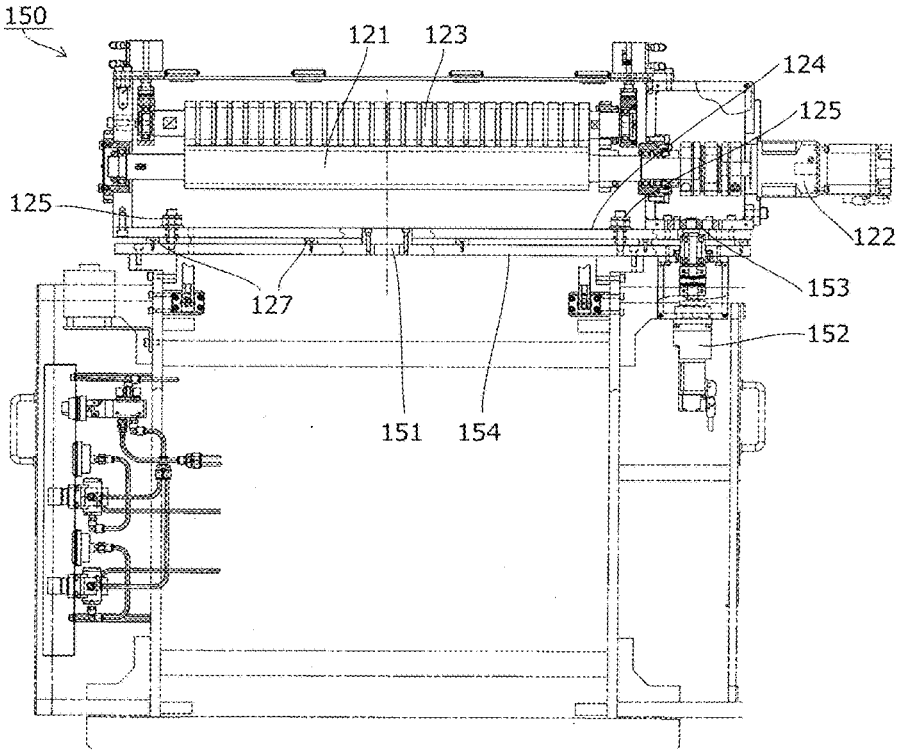
FIG. 6 is a front view of an intermittent feed roll of the bag making apparatus in one embodiment of the present invention.
Figure 7:
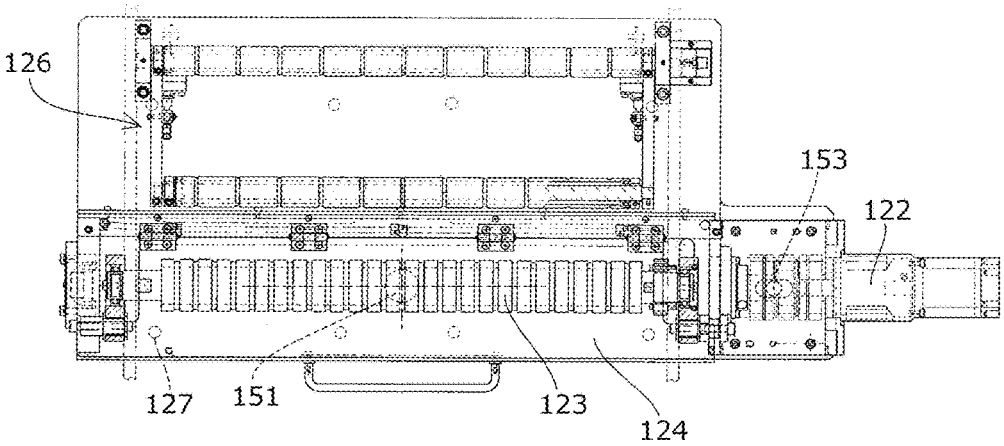
FIG. 7 is a plan view of the intermittent feed roll of the bag making apparatus in one embodiment of the present invention.
Figure 8:
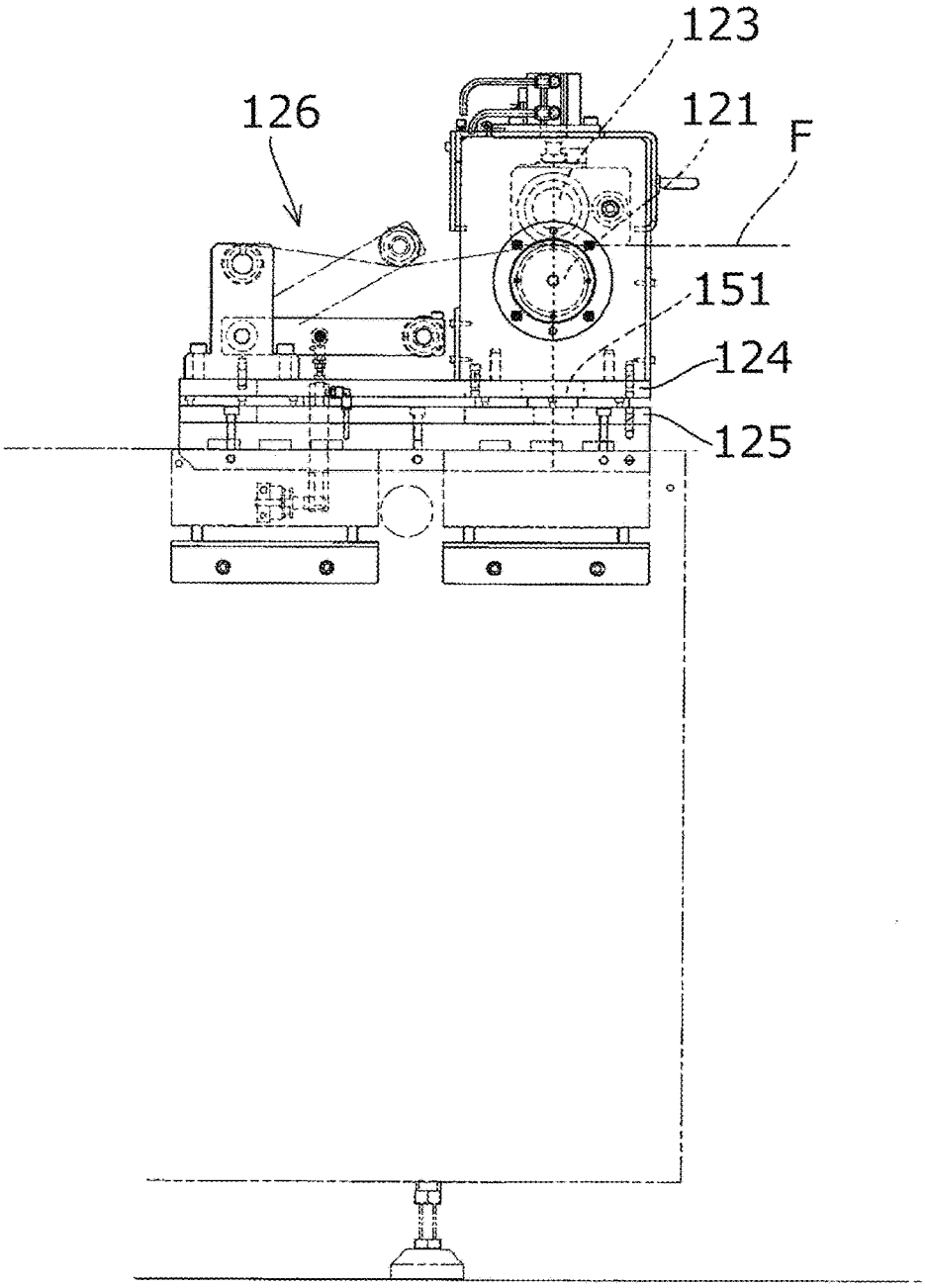
FIG. 8 is a side view of the intermittent feed roll of the bag making apparatus in one embodiment of the present invention.

Next, the structure and operation of the skew correction unit 150 will be described with reference to FIG. 6 to FIG. 8.

The skew correction unit 150 is configured to turn the intermittent feed roll 121 around an axial line passing the center in the width direction of the web of film F and extending perpendicularly to the web of film F.

The intermittent feed roll 121 is supported on an intermittent feed roll support table 124 rotatably and driven to rotate by the intermittent feed motor 122 secured on the intermittent feed roll support table 124.

Above the intermittent feed roll 121 is provided an intermittent feed pressing roll 123 so that the web of film F is sandwiched between the intermittent feed roll 121 and the intermittent feed pressing roll 123 and fed intermittently.

In the illustrated embodiment, a film holder 126 is further provided downstream of the intermittent feed roll 121 on the intermittent feed roll support table 124 so that tension and other parameters can be adjusted also on the downstream side.

The skew correction unit 150 is configured by the intermittent feed roll support table 124 being supported on a base table 154 provided on a stationary side such as to be able to turn via a rotation support shaft 151.

The rotation support shaft 151 is provided at the center in the width direction of the intermittent feed roll 121 and directly below the rotation center axis.

A skew correction motor 152 is provided on one side in the width direction of the base table 154. An eccentric cam 153 rotated by this skew correction motor 152 is configured to mesh with the intermittent feed roll support table 124. The intermittent feed roll support table 124 is thus configured to turn around the rotation support shaft 151 as the skew correction motor 152 is rotated in normal and reverse directions.

The skew correction motor 152 of the skew correction unit 150 is controlled to turn the intermittent feed roll support table 124 to an angle necessary for correcting a displacement in the width direction of the web of film F, which is detected by the optical detection unit 140 described in the foregoing.

On the upper surface of the base table 154 are a plurality of placement pieces 127, which support the weight of the intermittent feed roll support table 124 placed thereon such as to be slidable.

The base table 154 and the intermittent feed roll support table 124 are configured such that their positional relationship can be restricted with fixing bolts 125. The support table may be allowed to turn, or secured in position, by changing the fastening degree of the fixing bolts 125. Since the intermittent feed roll support table 124 can turn only very slightly, i.e., 0.1° or less, the fixing bolts 125 may be fastened such as to allow the table to turn by its resilience.

The configuration described above that allows turning of the intermittent feed roll 121 for skew correction enables correction of a skew in the web of film F without applying a large lateral force to the web of film F so that stability is improved. Thus, with the highly precise adjustment and reduced tension fluctuations, continuous operation is possible with higher precision and at higher speed.

In the embodiment shown in FIG. 1 and FIG. 2, two intermittent feed rolls 121 are provided in the section of the intermittent feed mechanism 120. While the skew correction unit 150 may be provided at least to a most downstream intermittent feed roll 121, providing the skew correction unit 150 to both intermittent feed rolls 121 will enable even more precise skew correction substantially over the entire section of the intermittent feed mechanism 120.

Next, the structure and operation of the seal position correction unit 180 will be described with reference to FIG. 9 to FIG. 11.

The plurality of sealing unit 171 used in the sealing mechanism 170 in this embodiment are heat sealing unit configured to seal necessary portions of the web of film F and the bottom material B by thermal bonding. The heat sealing unit are disposed at an interval corresponding to the pitch L of the pouch containers so that the sealing unit 171 repeat thermal bonding several times at the same portions as the web of film is intermittently fed by the intermittent feed mechanism 120.

Figure 9:
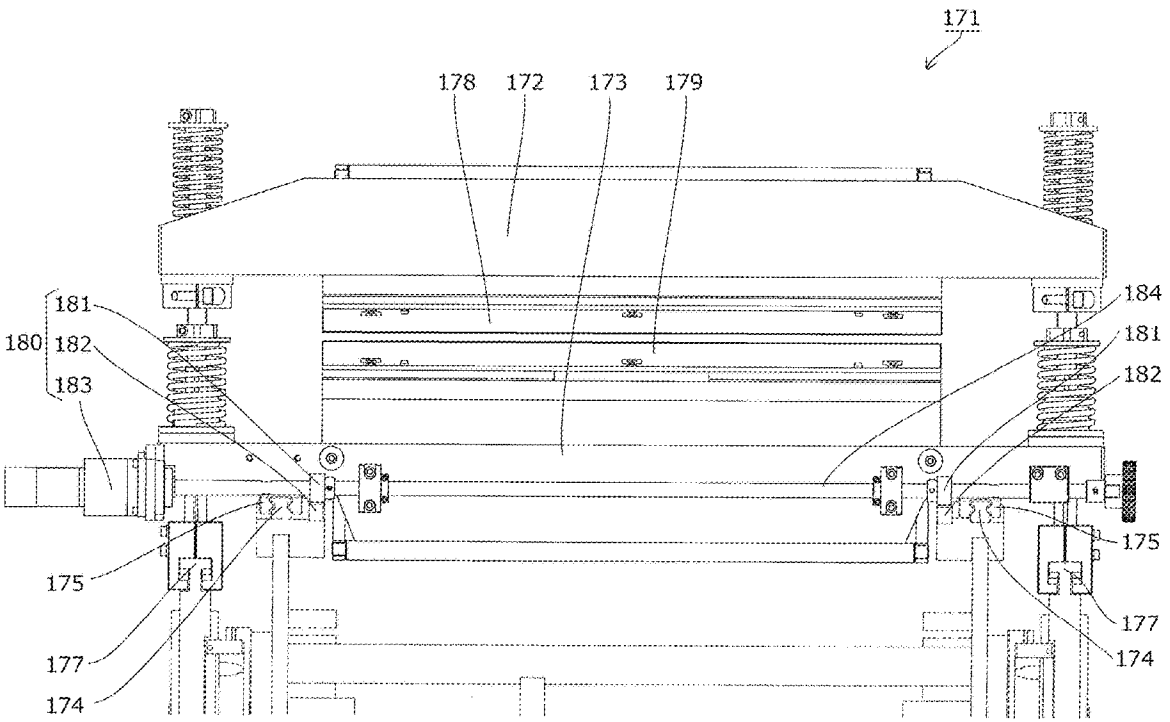
FIG. 9 is a front view of sealing unit of the bag making apparatus in one embodiment of the present invention.
Figure 10:
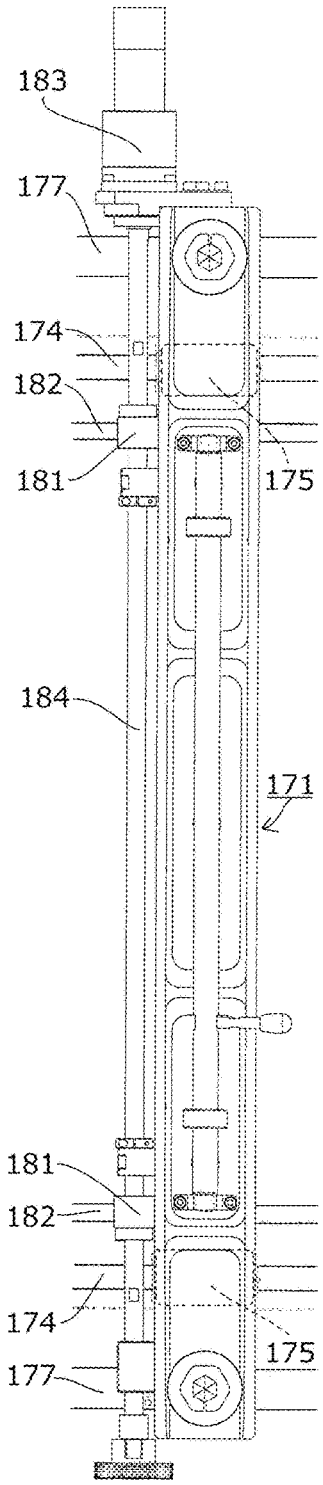
FIG. 10 is a plan view of the sealing unit of the bag making apparatus in one embodiment of the present invention.
Figure 11:
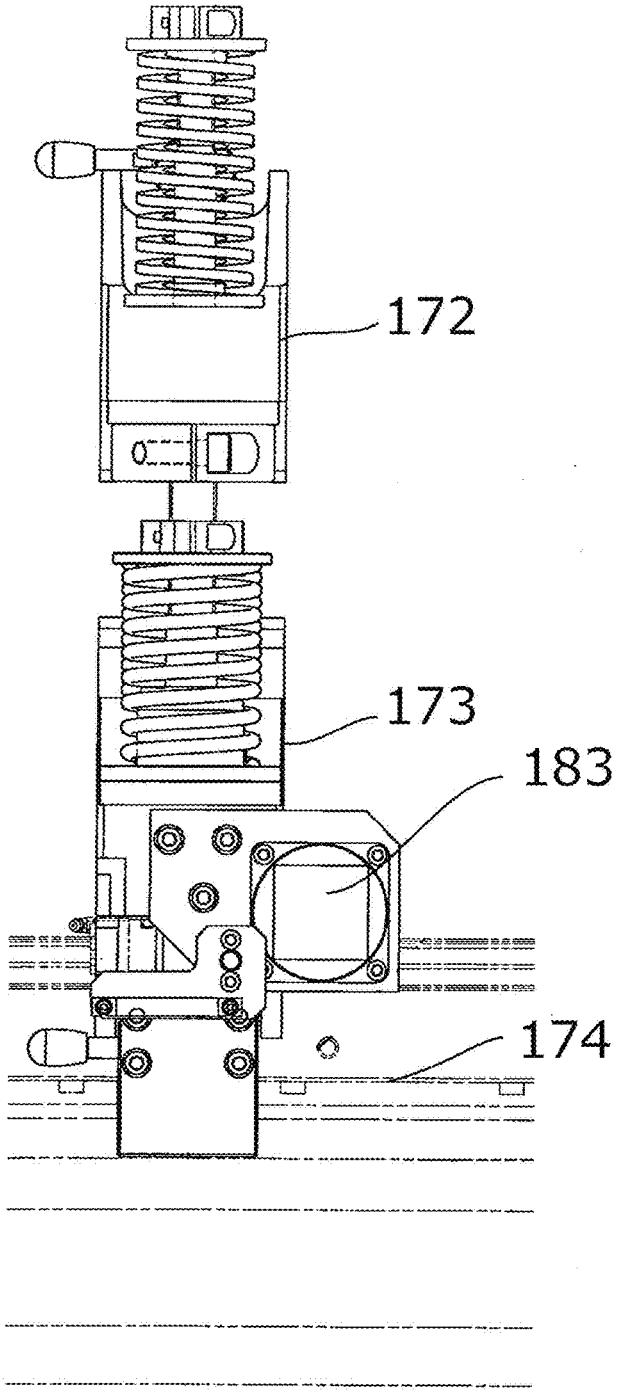
FIG. 11 is a side view of the sealing unit of the bag making apparatus in one embodiment of the present invention.

FIG. 9 to FIG. 11 show one of the sealing unit 171 that form thermal bonds at portions of the web of film F extending in the width direction.

The sealing unit 171 includes a lower frame 173 and an upper frame 172, each having a lower heat seal part 179 and an upper heat seal part 178 parallel to each other. The upper frame 172 is connected to a drive beam 177 to be movable in the feed direction of the web of film F, and moved up and down vertically to the lower frame 173. Thus the lower heat seal part 179 and the upper heat seal part 178 can sandwich the web of film F to form a thermal bond.

Two slide rails 174 extend parallel to the feed direction of the web of film F over the entire section of the intermittent feed mechanism 120, and sliders 175 that are movable on the slide rails 174 are provided on the lower side of the lower frame 173, so that the sealing unit 171 can freely move in the feed direction of the web of film F.

Two rack rails 182 extend parallel to the slide rails 174, with two pinion gears 181 meshing with the rack rails 182 and a pinion drive motor 183 for driving the pinion gears 181 provided on lateral ends below the lower frame 173, these forming the seal position correction unit 180.

In this embodiment, the two pinion gears 181 are fixed to a sealing unit drive shaft 184 rotatably supported at lateral ends below the lower frame 173, and one end of the sealing unit drive shaft 184 is coupled to the pinion drive motor 183.

With this configuration, the pinion drive motor 183 is driven in accordance with the pitch L1 of one pouch container calculated by the optical detection unit 140 as described above, to set the positions of and spacing between the plurality of sealing unit 171.

As the rack rails 182 are secured in position at multiple points, a degradation of precision caused by deformation is prevented with a simple structure. As the pinion gears 181, as well as the pinion drive motor 183, sealing unit drive shaft 184, and other parts for driving the pinion gears, can be provided on lateral ends below the sealing unit to be exposed, the structure of the sealing unit 171 is simplified. Thus, while precision is maintained, the structure of the entire apparatus is made lighter and simpler to make the maintenance easy.

The above described structure may be employed also for a crossing member that couples together the lower frames in the width direction in the sealing unit configured to seal both lateral edges in the feed direction of the web of film F (in the upstream-side sealing mechanism 170 shown in FIG. 1 and FIG. 2), to achieve the same advantageous effects.

Although one embodiment of the present invention has been illustrated, the invention is not limited to this, and may have any other specific configurations, as long as: the feed adjustment mechanism includes swinging drive unit configured to move a dancer roll, a tension detection roll provided upstream of the dancer roll for the web of film to pass over, a tension sensor that detects a force on the tension detection roll, and tension control unit configured to control feed speed of the continuous feed roll in accordance with the detection value of the tension sensor; the intermittent feed mechanism includes optical detection unit configured to recognize a plurality of marks on a surface of the web of film simultaneously at respective positions, feed amount adjustment unit capable of adjusting a feed amount for one intermittent feed, and skew correction unit configured to correct a displacement of the recognized marks from an original position in a direction perpendicular to the feed direction of the web of film; and the sealing mechanism includes a plurality of sealing unit provided in a section where the web of film is intermittently fed by the intermittent feed mechanism, and seal position correction unit configured to adjust positions in the feed direction of the plurality of sealing unit in accordance with the positions of the marks in the feed direction of the web of film which are recognized by the optical detection unit.

INDUSTRIAL APPLICABILITY

The bag making apparatus of the present invention is suited for producing pouch containers made of plastic film and formed into a bag shape by sealing, in particular, but not limited to apparatuses that make bags by sealing, and may also be applied to production apparatuses that perform various processing and treatment precisely to a continuously fed sheet-like material under stable tension.

The invention claimed is:

1. A bag making apparatus, comprising:

a continuous feed mechanism having a continuous feed roll continuously feeding a web of film;

an intermittent feed mechanism having an intermittent feed roll intermittently feeding the web of film;

a feed adjustment mechanism having a reciprocally movable dancer roll between the continuous feed mechanism and the intermittent feed mechanism; and a sealing mechanism sealing predetermined portions of the web of film fed by the intermittent feed mechanism, wherein the feed adjustment mechanism includes a swinging drive unit for the dancer roll, a tension detection roll provided upstream of the dancer roll, a tension sensor detecting tension on the tension detection roll, and a tension control unit configured to control a feed speed of the continuous feed roll in accordance with a detection value of the tension sensor, wherein the intermittent feed mechanism includes an optical detection unit configured to recognize a plurality of marks on a surface of the web of film simultaneously at respective positions, a unit configured to adjust an intermittent feed amount, and a skew correction unit configured to correct a displacement of the web of film in a direction perpendicular to a feed direction, wherein the sealing mechanism includes a plurality of sealing units provided in a section where the web of film is intermittently fed, and a seal position correction unit configured to adjust positions in the feed direction of the plurality of sealing units in accordance with positions of the marks in the feed direction of the web of film which are recognized by the optical detection unit, and wherein the swinging drive unit is set to move the dancer roll reciprocally in a predetermined range, and the tension control unit outputs a signal to the swing drive unit to change a swing end position of the swinging drive unit based on varying detection values of the tension sensor such that variation in the detection values of the tension sensor is reduced.

2. The bag making apparatus according to claim 1, wherein the tension detection roll is fixed in position such that it is not movable other than being rotatable about its own axis, and the tension sensor is configured to detect a force applied to a rotation shaft of the tension detection roll.

3. The bag making apparatus according to claim 1, wherein the swinging drive unit is set to move the dancer roll reciprocally at a predetermined speed and in a predetermined range, and the tension control unit controls the feed speed of the continuous feed roll based on varying detection values of the tension sensor such that the detection values of the tension sensor remain around a predetermined value.

4. The bag making apparatus according to claim 1, wherein the tension control unit lowers a continuous feed speed of the continuous feed mechanism when the moving range of the swinging drive unit is increased, and raises the feed speed of the continuous feed mechanism when the moving range of the swinging drive unit is decreased.

5. The bag making apparatus according to claim 1, wherein either:

(a) the tension control unit controls the swinging drive unit in consideration of information on positions of the marks in the feed direction of the web of film which are recognized by the optical detection unit, (b) the tension control unit controls the feed speed of the continuous feed roll in further consideration of information on positions of the marks in the feed direction of the web of film which are recognized by the optical detection unit, or (c) the tension control unit controls the swinging drive unit in consideration of information on positions of the marks in the feed direction of the web of film which are recognized by the optical detection unit and controls the feed speed of the continuous feed roll in further consideration of information on positions of the marks in the feed direction of the web of film which are recognized by the optical detection unit.

6. The bag making apparatus according to claim 5, wherein the tension control unit changes a predetermined value around which detection values of the tension sensor are to remain when there is a displacement in the positions of the marks in the feed direction of the web of film which are recognized by the optical detection unit which is larger than a predetermined displacement.

7. The bag making apparatus according to claim 1, wherein the optical detection unit includes a plurality of two-dimensional optical sensors provided above the intermittent feed mechanism and spaced apart in the feed direction, and is configured to be able to detect two-dimensional positions of the marks provided on the surface of the web of film when the web of film is at halt.

8. The bag making apparatus according to claim 7, wherein the feed amount adjustment unit is configured to determine a feed amount for one intermittent feed in accordance with information on the positions of the marks in the feed direction of the web of film which are recognized by the plurality of two-dimensional optical sensors.

9. The bag making apparatus according to claim 7, wherein the seal position correction unit is configured to adjust spacing between the plurality of sealing units in the feed direction in accordance with information on the positions of the marks in the feed direction of the web of film which are recognized by the plurality of two-dimensional optical sensors.

10. The bag making apparatus according to claim 7, wherein the plurality of two-dimensional optical sensors are spaced apart by a distance corresponding to a feed amount of several intermittent feeds of the web of film.

11. The bag making apparatus according to claim 1, wherein the intermittent feed mechanism further comprises at least one additional intermittent feed roll, such that the intermittent feed mechanism comprises a plurality of intermittent feed rolls, and the skew correction unit is configured to turn at least one of the intermittent feed rolls around an axial line passing a center in the width direction of the web of film and extending perpendicularly to the web of film.

12. The bag making apparatus according to claim 11, wherein the skew correction unit is configured to turn the plurality of intermittent feed rolls in accordance with a relative displacement of a printed pattern on the web of film in a direction perpendicular to the feed direction recognized by the plurality of two-dimensional optical sensors.

13. The bag making apparatus according to claim 1, wherein the seal position correction unit is formed by a rack rail extending in the feed direction of the web of film, a pinion gear provided to each sealing unit to mesh with the rack rail, and a pinion drive motor provided for each sealing unit to drive the pinion gear.

14. The bag making apparatus according to claim 1, wherein the intermittent feed mechanism is configured to intermittently feed upper and lower webs of film with a bottom material interposed between the two webs of film, and the sealing mechanism is configured to seal the bottom material together with the two, upper and lower, webs of film.

15. The bag making apparatus according to claim 1, wherein a cutting mechanism is provided downstream of the intermittent feed mechanism to cut the web of film after sealing to separate the web of film into discrete pouch containers.

* * * * *